US007266325B2

(12) United States Patent
Hirose et al.

(10) Patent No.: US 7,266,325 B2
(45) Date of Patent: Sep. 4, 2007

(54) IMAGE FORMING DEVICE CAPABLE OF ALIGNING A PLURALITY OF COVERS

(75) Inventors: Atsuo Hirose, Nagoya (JP); Yoshiyuki Ito, Nagoya (JP); Hidetoshi Yano, Toukai (JP); Sakae Ito, Nishikasugai-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 107 days.

(21) Appl. No.: 10/893,602

(22) Filed: Jul. 19, 2004

(65) Prior Publication Data

US 2005/0019058 A1 Jan. 27, 2005

(30) Foreign Application Priority Data

Jul. 22, 2003 (JP) ..... 2003-277619

(51) Int. Cl.
*G03G 15/00* (2006.01)
*G03G 21/00* (2006.01)

(52) U.S. Cl. ..... 399/107; 399/110; 399/124; 399/125

(58) Field of Classification Search ..... 399/110, 399/107, 124, 125
See application file for complete search history.

(56) References Cited

U.S. PATENT DOCUMENTS 5,587,769 A * 12/1996 Sawada et al. ..... 399/110
5,991,570 A * 11/1999 Haga et al. ..... 399/125
6,038,417 A * 3/2000 Nagamine et al. ..... 347/116
6,408,161 B1 6/2002 Minowa et al.
6,722,647 B2 * 4/2004 Kato et al. ..... 399/110
6,796,736 B1 * 9/2004 Shiraishi et al. ..... 399/110
2004/0091283 A1 * 5/2004 Nobe et al. ..... 399/110

FOREIGN PATENT DOCUMENTS

JP A 2000-347319 12/2000
JP A 2001-302073 10/2001
JP A 2002-29116 1/2002

* cited by examiner

*Primary Examiner*—David M. Gray
*Assistant Examiner*—Ruth N. LaBombard
(74) *Attorney, Agent, or Firm*—Oliff & Berridge, PLC

(57) ABSTRACT

A front cover and an upper panel of the image forming device is engaged with each other by an engagement mechanism. The engagement mechanism includes a claw and an engagement member that engages with the claw. The claw is disposed on an upper section of the front cover, and the engagement member is disposed on the upper panel. The engagement mechanism further includes surfaces of the front cover and ribs that abut the surfaces. The ribs are provided to the upper section of the front cover and protrude in a direction perpendicular to a direction in which the front cover is opened and closed.

18 Claims, 10 Drawing Sheets

IMAGE FORMING DEVICE CAPABLE OF ALIGNING A PLURALITY OF COVERS

BACKGROUND OF THE INVENTION

1. Field of the Invention

The present invention relates to an image forming device, such as a copier, printer, or facsimile machine, that uses an electrophotographic method or an electrostatic recording method to form an image.

2. Related Art

An image forming device includes a main casing, an image forming section, and a frame. The image forming section is disposed in the main casing and forms images on a recording sheet. The frame is housed inside the main casing and supports the image forming section within the main casing. The main casing includes a plurality of covers. These covers are aligned suitably to form the overall external design of the image forming device.

Conventionally, the positions of the covers are determined with reference to the frame accommodated in the main casing. For that reason, it is difficult to align the covers suitably. For example, gaps between the covers may too large or too small. It is therefore difficult to provide a neat appearance to the exterior of the image forming device.

SUMMARY OF THE INVENTION

In the view of foregoing, it is an object of the present invention to overcome the above problems, and also to provide an image forming device capable of aligning a plurality of covers in an appropriate and simple manner.

In order to attain the above and other objects, according to one aspect of the present invention, there is provided an image forming device including a casing, an image forming unit, a frame, and a first engagement mechanism. The casing includes a front cover that covers a front surface of the casing, an upper panel that covers an upper surface of the casing, and a side panel that covers a side surface of the casing. The image forming unit forms images on a recording medium. The frame supports the image forming unit within the casing, and the first engagement mechanism engages the front cover with the upper panel. The front cover includes an upper portion and a side portion. The upper portion partially overlaps the upper panel. The side portion is formed in continuous with the front portion and partially overlaps the side panel. An opening is formed as a rectangular cut-out in part of the upper panel, and the image forming unit is inserted into or removed from the casing through the opening. When the front cover is closed, the upper portion of the front cover covers the opening, and the front cover engages with the upper panel by the first engagement mechanism.

According to another aspect of the present invention, there is also provided a casing of an image forming device. The casing includes a front cover that covers a front surface of the casing, an upper panel that covers an upper surface of the casing, a side panel that covers a side surface of the casing, a first claw provided to one of the front cover and the second cover, and a first engagement member provided to the other one of the front cover and the second cover. The front cover includes an upper portion and a side portion. The upper portion partially overlaps the upper panel. The side portion is formed in continuous with the front portion and partially overlaps the side panel. The first engagement member engages with the first claw, thereby positioning the front cover at a predetermined location relative to the front cover. An opening, through which an image forming unit is inserted into or removed from the casing, is formed as a rectangular cut-out in part of the upper panel. When the front cover is closed, the upper portion of the front cover covers the opening, and the front cover engages with the upper panel by the first engagement mechanism

PREFERRED EMBODIMENT OF THE PRESENT INVENTION

Next, an image forming device according to an embodiment of the present invention will be described with reference to the accompanying drawings. In the following description, the expressions "front", "rear", "upper", "lower", "right", and "left" are used to define the various parts when the image forming device is disposed in an orientation in which it is intended to be used.

Figure 1:
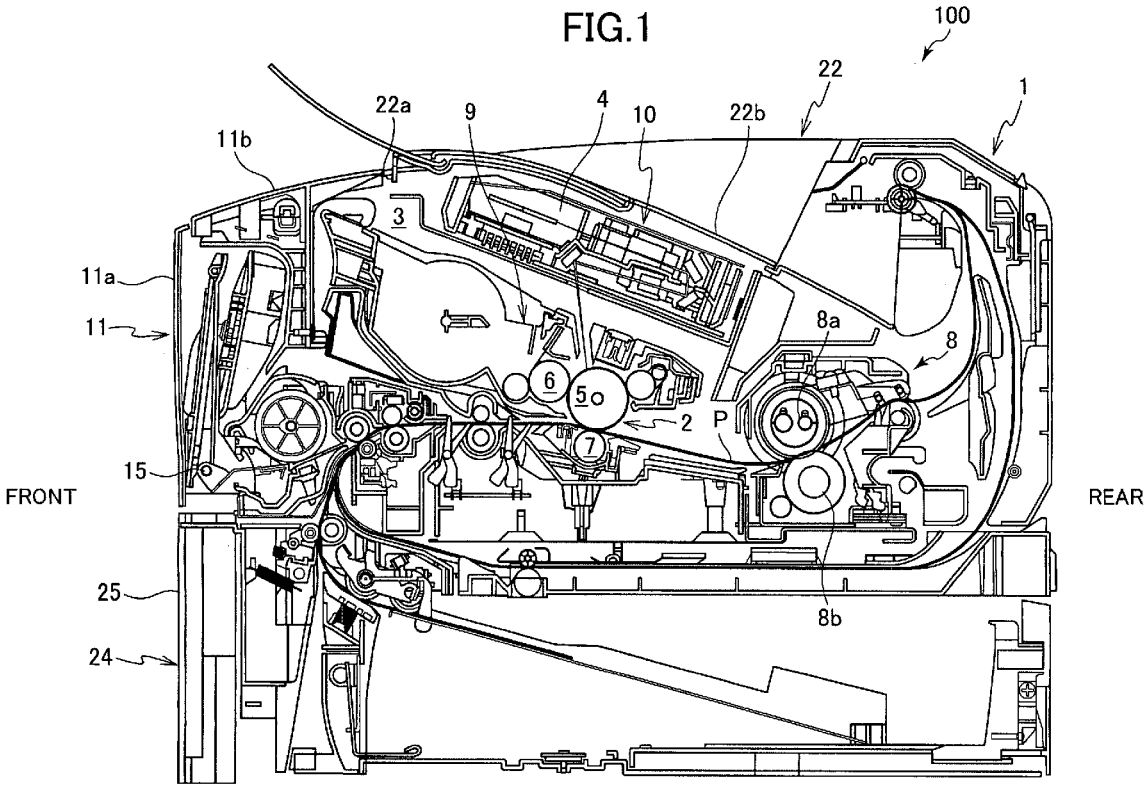
FIG. 1 is a cross-sectional view of an image forming device according to an embodiment of the present invention.

As shown in FIG. 1, an image forming device 100 according to the present embodiment includes an image forming unit 2, a left side frame 3, and a right side frame (not shown), all disposed inside a main casing 1.

The image forming unit 2 is for forming images on a paper P and includes a scanner unit 10, a process cartridge 9, and a fixing unit 8. The scanner unit 10 includes an irradiation unit 4. The process cartridge 9 is detachably accommodated in the main casing 1 and accommodates a photosensitive drum 5, a developing roller 6, and a transfer roller 7. The fixing unit 8 includes a heat roller 8*a* and a pressing roller 8*b*.

Each of those components are supported inside the main casing 1 at predetermined locations between the left side frame 3 and the right side frame.

Figure 2:
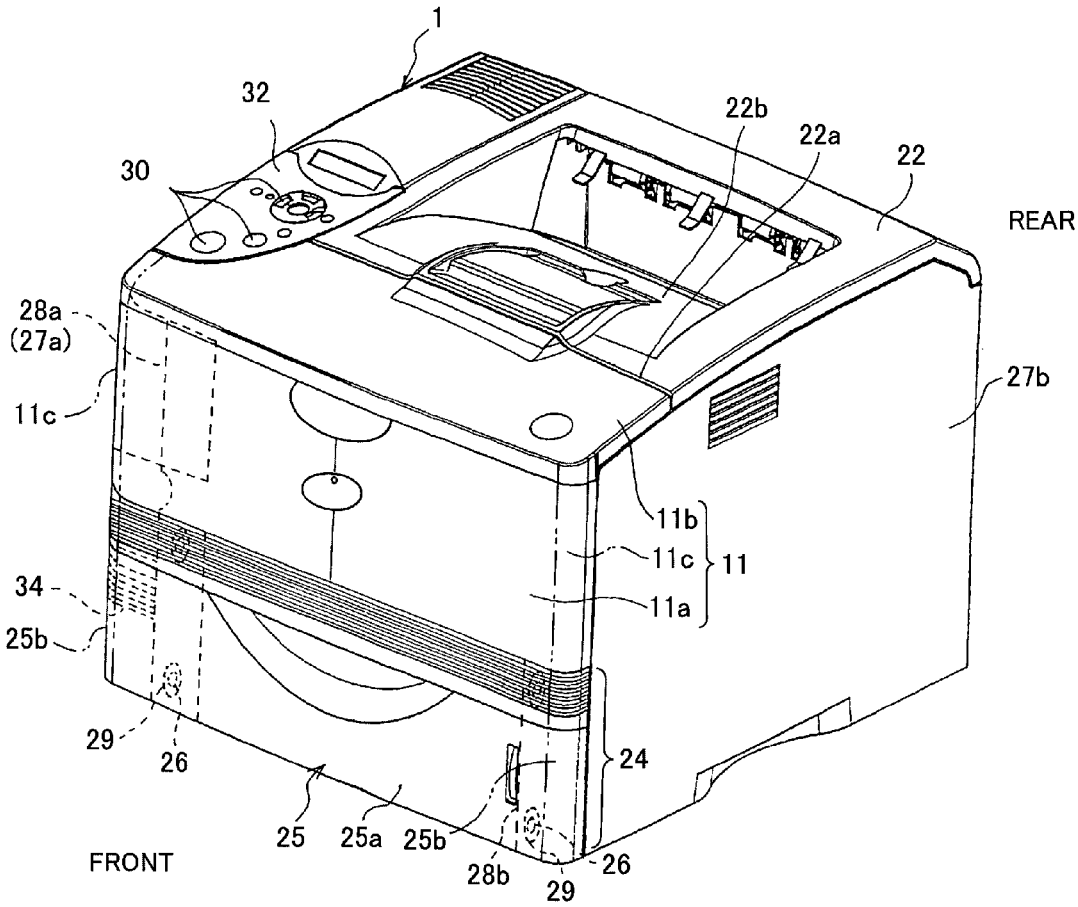
FIG. 2 is an external perspective view of the image forming device of FIG. 1.

As shown in FIG. 2, the main casing 1 includes a first front cover 11, an upper panel 22, a left-side cover 27*a*, a right-side cover 27*b*, all of which are formed of resin.

The first front cover 11 includes a first front portion 11*a*, an upper portion 11*b*, and left and right side portions 11*c*.

The first front portion 11*a* covers the front surface of the image forming device 100. The upper portion 11*b* is formed in continuation with the first front portion 11*a* and covers a part of the upper surface of the image forming device 100.

The left and right side portions 11*c* are formed in continuation with the first front portion 11*a* and cover parts of the left and right side surfaces of the image forming device 100. When the first front cover 11 is closed, the upper portion 11*b* overlaps an front edge portion 22*c* of the upper panel 22, and the side portion 11*c* overlaps front edge portions 27*c* of the left-side and right-side covers 27*a* and 27*b*.

Providing the upper portion 11*b* ensures that the boundary between the first front cover 11 and the top cover 22 does not appear on the front surface, providing a neat appearance to the front surface of the image forming device 100. Also, providing the left and right side portions 11*c* ensures that the boundaries between the first front cover 11 and the left-side and right-side covers 27*a* and 27*b* dot not appear on the front surface, providing a neat appearance to the front surface of the image forming device 100.

Figure 3:
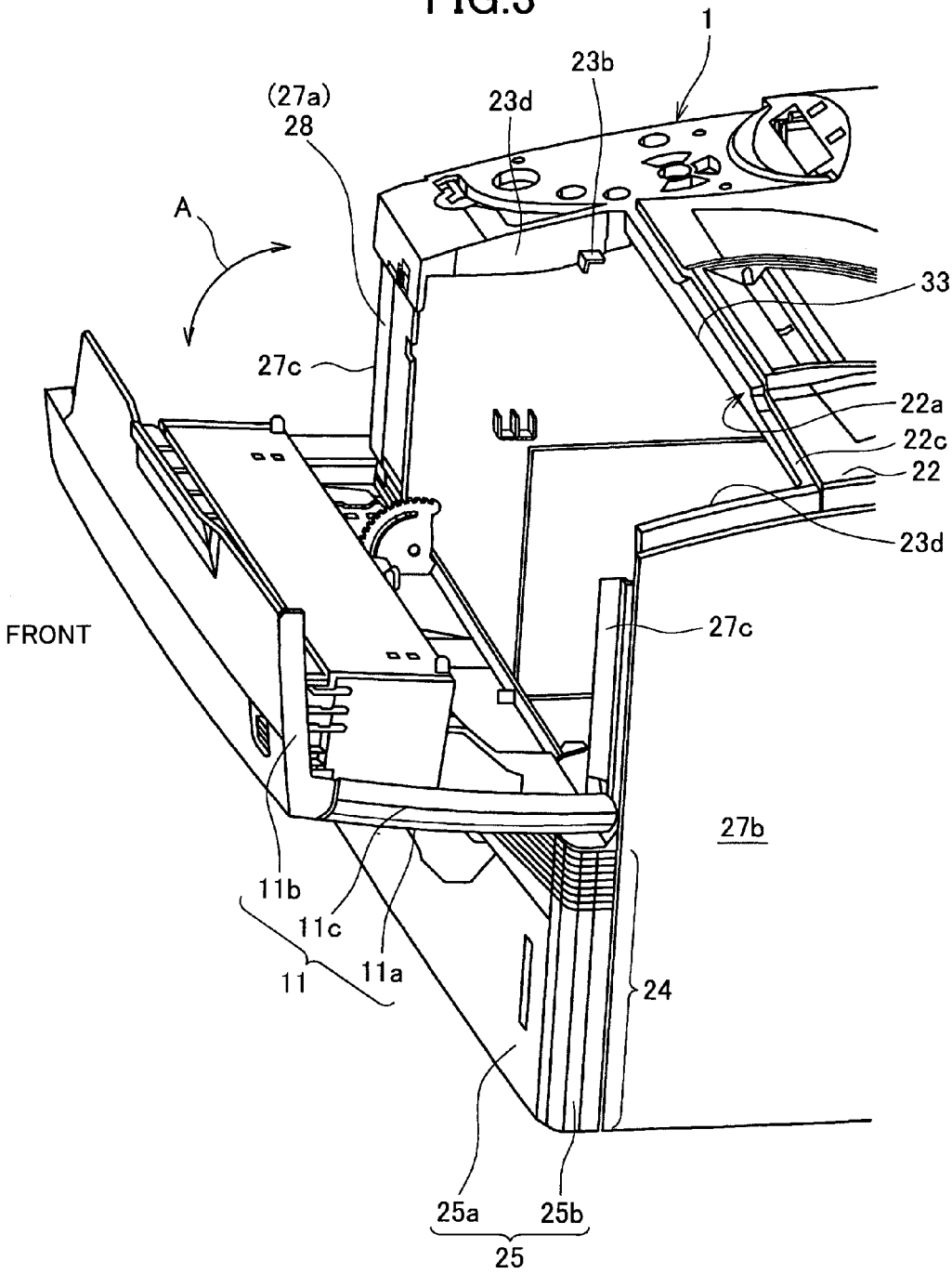
FIG. 3 is a perspective view of the image forming device of FIG. 1 wherein a first front cover is opened.

The upper panel 22 is formed with a recess serving as a discharge tray 22*b*. As shown in FIGS. 2 and 3, the upper panel 22 is also formed with an opening 22*a* for receiving the upper portion 11*b* of the first front cover 11.

As shown in FIG. 3, the opening 22*a* is defined by left and right surfaces 23*d* and a rear surface 33 that connects rear edge portions of the left and right surfaces 23*d*, and is formed as a rectangular cut-out in part of the front edge portion of the top cover 22. When the upper portion 11*b* is accommodated in the opening 22*a*, the upper portion 11*b* serves as the front edge portion of the upper surface of the image forming device 100 that is in continuation with the top cover 22.

Although not shown in the drawings, a shaft is disposed at the lower end of the first front cover 11 to extend in the horizontal direction. The first front cover 11 is freely pivotable about the shaft so that the free end of the first front cover 11 (that is, the upper end at the upper portion 11*b* side) can open and close by moving in a direction A (FIG. 3). Components of the image forming portion 2, such as the process cartridge 9, can be inserted to and removed from the main casing 1 by opening the first front cover 11.

Figure 4:
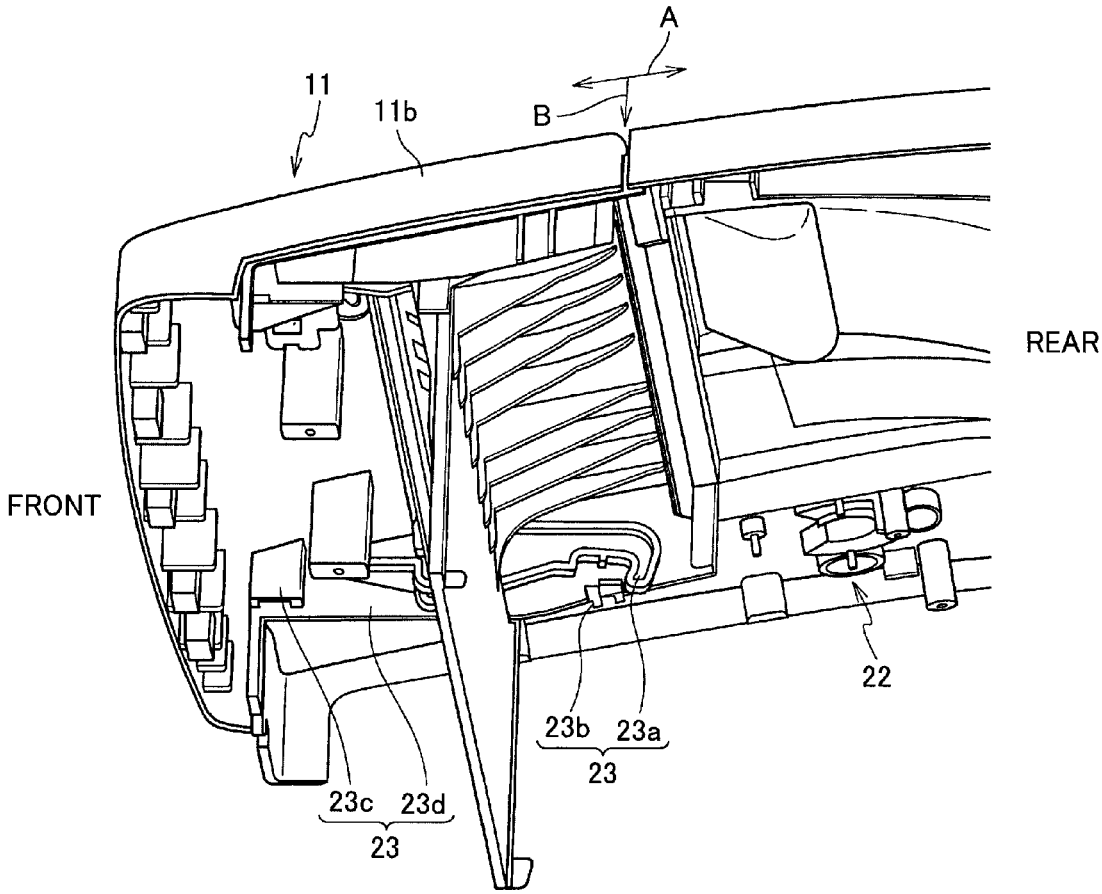
FIG. 4 is a perspective view of an upper portion of the first front cover and an upper panel of the image forming device as viewed from the inside of a main casing.
Figure 5:
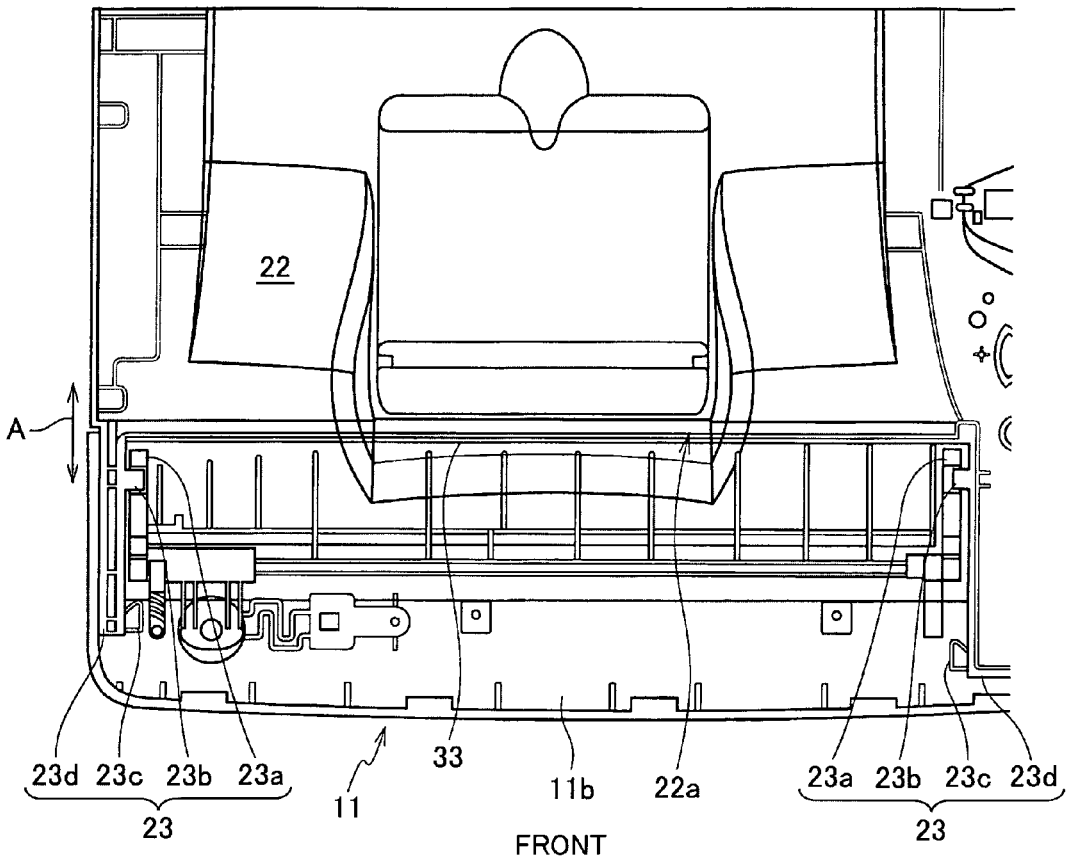
FIG. 5 is a plan view showing upper portion of the first front cover and the upper panel as viewed from below.

As shown in FIGS. 4 and 5, the image forming device 100 further includes a first engagement mechanism 23 for engaging the first front cover 11 with the upper panel 22. That is, the positions of the first front cover 11 and the top cover 22 relative to each other are determined by the first engagement mechanisms 23. This configuration prevents the gap between the first front cover 11 and the top cover 22 from being larger than necessary, so that the exterior gives the impression of a single uniform cover, providing a neat appearance to the exterior of the image forming device 100.

The first engagement mechanism 23 includes first claws 23*a*, first engagement portions 23*b*, ribs 23*c*, and the surfaces 23*d* which serve as the left and right surfaces of the opening 22*a*.

The first claws 23*a* are provided on one of the first front cover 11 and the upper panel 22, and the first engagement portions 23*b* are provided on the other of the first front cover 11 and the upper panel 22.

In this example, the first claws 23*a* are provided on the inner surface of the upper portion 11*b* of the first front cover 11 at left and right ends, and the first engagement portions 23*b* are provided on the upper panel 22. The first claw 23*a* has a substantially clamp shape extending along the inner surface of the upper portion 11*b*.

As shown in FIG. 3, the first engagement portions 23*b* are protrusions provided one for each of the left and right surfaces 23*d* of the opening 22*a*. When the first front cover 11 is closed, the first engagement portion 23*b* engages with a recess of the corresponding first claw 23*a*. In this manner, the first claws 23*a* are positioned at predetermined locations with respect to the opening/closing direction A in which the first front cover 11 pivots. This configuration allows to easily perform the positioning of both the first front cover 11 relative to the top cover 22 with respect to the opening/closing direction A, i.e., the front-to-rear direction of the image forming device 100.

Note that the first engagement portions 23*b* could be provided on the rear surface 33 (FIG. 3). In this case, the first engagement portion 23*b* should be formed with holes or recesses into which the clamp-shaped first claws 23*a* can fit.

Next, the ribs 23*c* and the surfaces 23*d* of the first engagement mechanism 23 will be described.

The ribs 23*c* are provided on either the first front cover 11 and the upper panel 22, and the surfaces 23*d* are provided on the other of the first front cover 11 and the upper panel 22. The ribs 23*c* protrude in a direction B orthogonal to the opening/closing direction A of the first front cover 11.

In this example, the ribs 23*c* are provided on right and left edges of the upper portion 11*b* of the first front cover 11 as shown in FIGS. 4 and 5. When the first front cover 11 is closed, the left and right ribs 23*c* fit between and contact the left and right surfaces 23*d*. This configuration enables to easily and reliably position the first front cover 11 and the top cover 22 relative to each other, in the lateral direction of the image forming device 100.

As described above, because the first engagement mechanism 23 is provided, it is possible to provide a neat appearance to the front surface of the image forming device 100 in a simple and reliable manner. Also, because some components of the image forming section 2, such as the process cartridge 9, can be inserted to and removed from the main casing 1 by opening the first front cover 11, it is possible to provide a neat appearance to the front surface while preserving the maintainability of the image forming portion 2.

As shown in FIG. 1, the image forming device 100 further includes a sheet cassette 24 located below the first front cover 11. The sheet cassette 24 is capable of supporting a stack of paper P to be supplied to the image forming unit 2. The sheet cassette 24 has a second front cover 25 that covers the front surface of the sheet cassette 24.

As shown in FIG. 2, the second front cover 25 includes a second front portion 25*a* and left and right side portions 25*b*. The second front portion 25*a* covers the front surface of the sheet cassette 24, and the right and left side portions 25*b* are formed continuous with the second front portion 25*a*.

The second front portion 25*a* and the left and right side portions 25*b* are formed in continuous with the lower portions of the first front portion 11*a* and the left and right side portions 11*c* of the first front cover 11.

Therefore, when the paper cassette 24 is installed, the first front cover 11 and the second front cover 25 give an impression of continuity, providing a neat appearance to the front surface of the image forming device 1.

Figure 6:
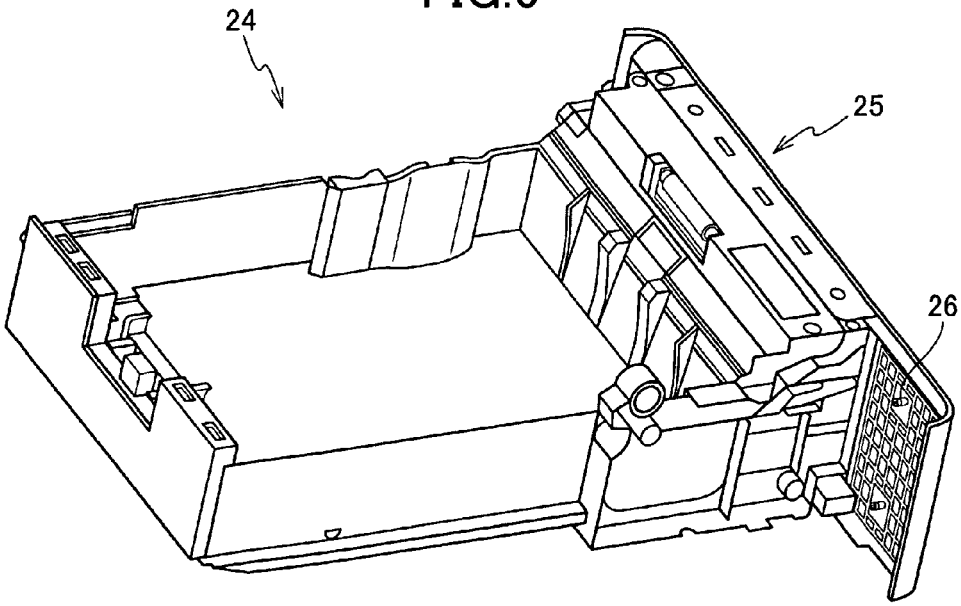
FIG. 6 is a perspective view of a sheet cassette of the image forming device.
Figure 7:
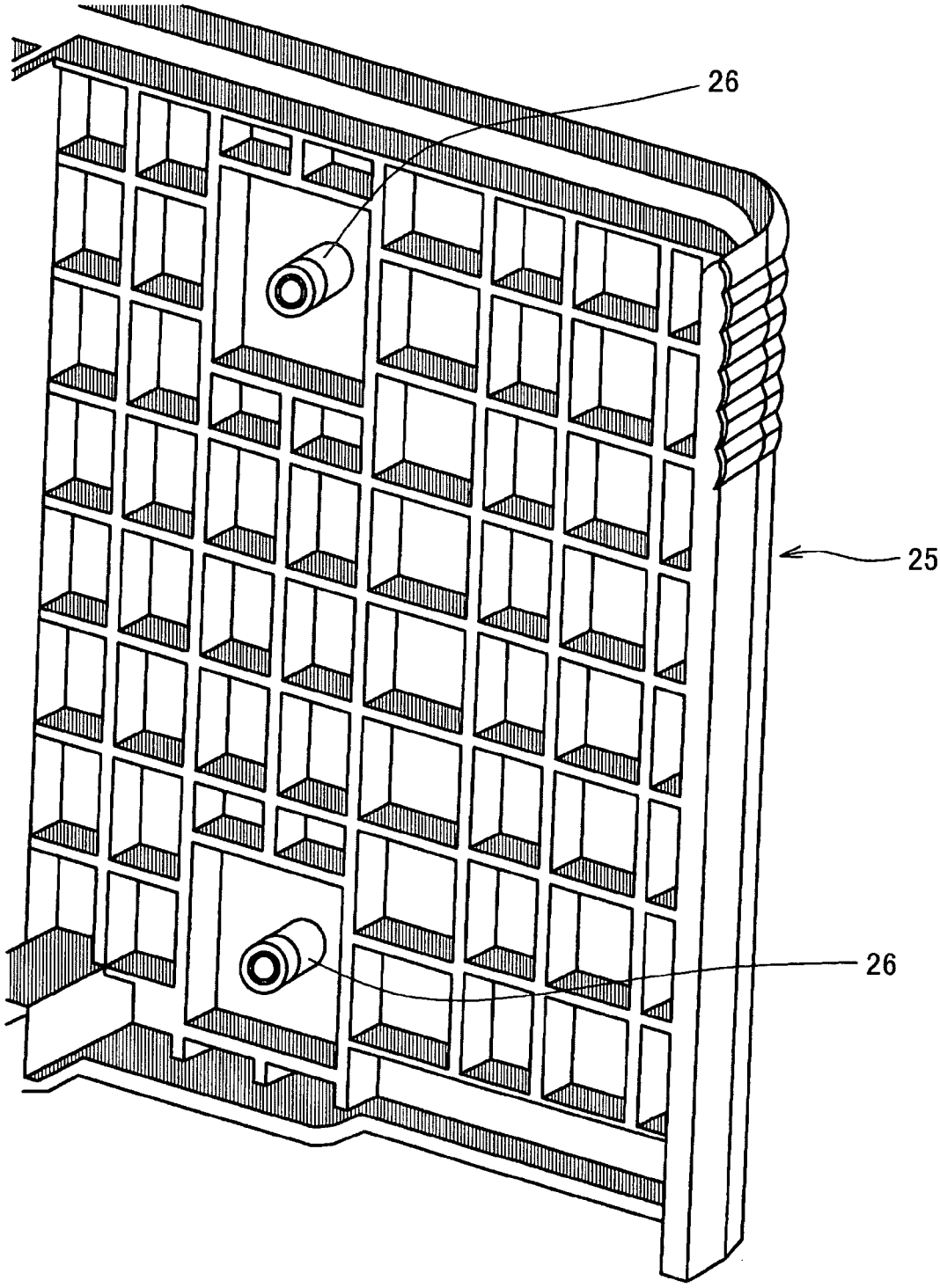
FIG. 7 is an enlarged perspective view of an inner surface of a second front surface of the sheet cassette of FIG. 6.

As shown in FIGS. 6 and 7, two cassette cover engagement members 26 arranged in the vertical directions are provided on the inner surface of the second front cover 25 at each of the right and left section. The cassette cover engagement members 26 have a circular column shape protruding inward, and engage with the respective left and right side covers 27*a* and 27*b* shown in FIGS. 2 and 3.

Figure 8:
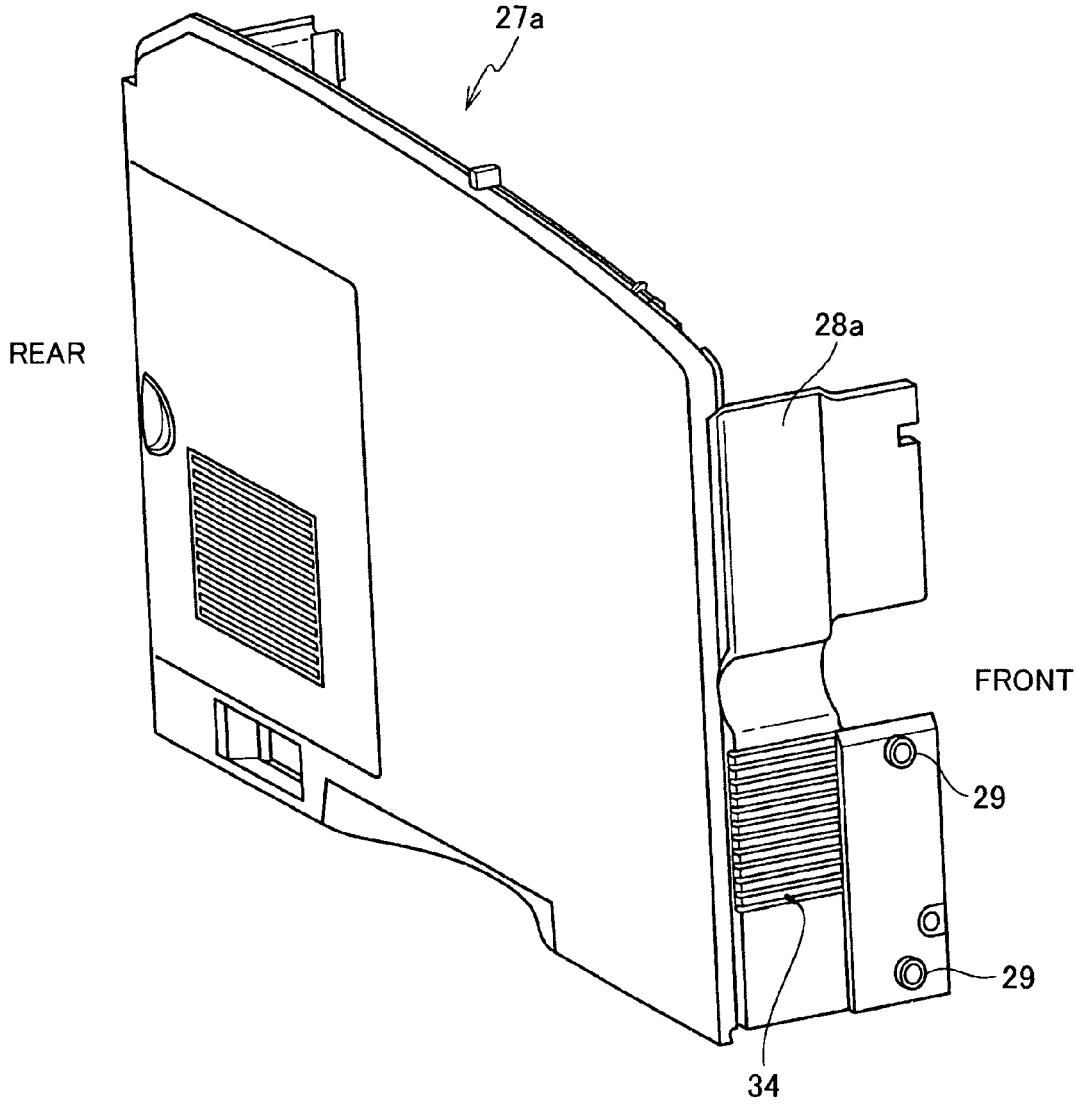
FIG. 8 is a perspective view of a left side cover of the image forming device.

More specifically, as shown in FIG. 8, the left side cover 27*a* is provided with a front portion 28*a* that extends to the right at the front side of the image forming device 100. The front portion 28 is provided with two side engagement members 29 arranged in the vertical direction and corresponding to the cassette cover engagement members 26.

Each of the side engagement members 29 has a short circular cylindrical shape and protrudes towards the front side of the image forming device 100. The inner diameter of each side engagement member 29 is larger than the outer dimension of the cassette cover engagement member 26.

Similarly, as shown in FIG. 2, the right side cover 27*b* is provided with a front portion 28*b* that is formed with two side engagement members 29.

When the paper cassette 24 is installed, the cassette cover engagement members 26 are inserted into the side engagement members 29, thereby positioning the paper cassette 24 at a predetermined location (FIG. 2) and also providing a neat appearance to the front of the image forming device 100.

It should be noted that the cassette cover engagement members 26 and the side engagement members 29 may have different shapes. For example, each cassette cover engagement member 26 may have a circular cylindrical shape, and each side engagement member 29 may have as a circular column shape.

As shown in FIG. 8, the front portion 28*a* of the left side cover 27*a* is formed with ventilation holes 34 for providing ventilation between the interior and exterior of the image forming device 100. As shown in FIG. 2, the ventilation holes 34 are covered by the second front cover 25 when the paper cassette 24 is installed. Providing the ventilation holes 34 in the front surface side of the image forming device 100 improves the ventilation efficiency, but does not damage the appearance of the front surface because of the second front cover 25.

A power source may be disposed in an upright posture at an inner side of the left side cover 27*a*, and a suction fan may be disposed behind the front portion 28*a*. In this case, the ventilation efficiency of the ventilation holes 34 is improved, causing a rapid airflow from the front to the rear of the image forming device 100.

Figure 9:
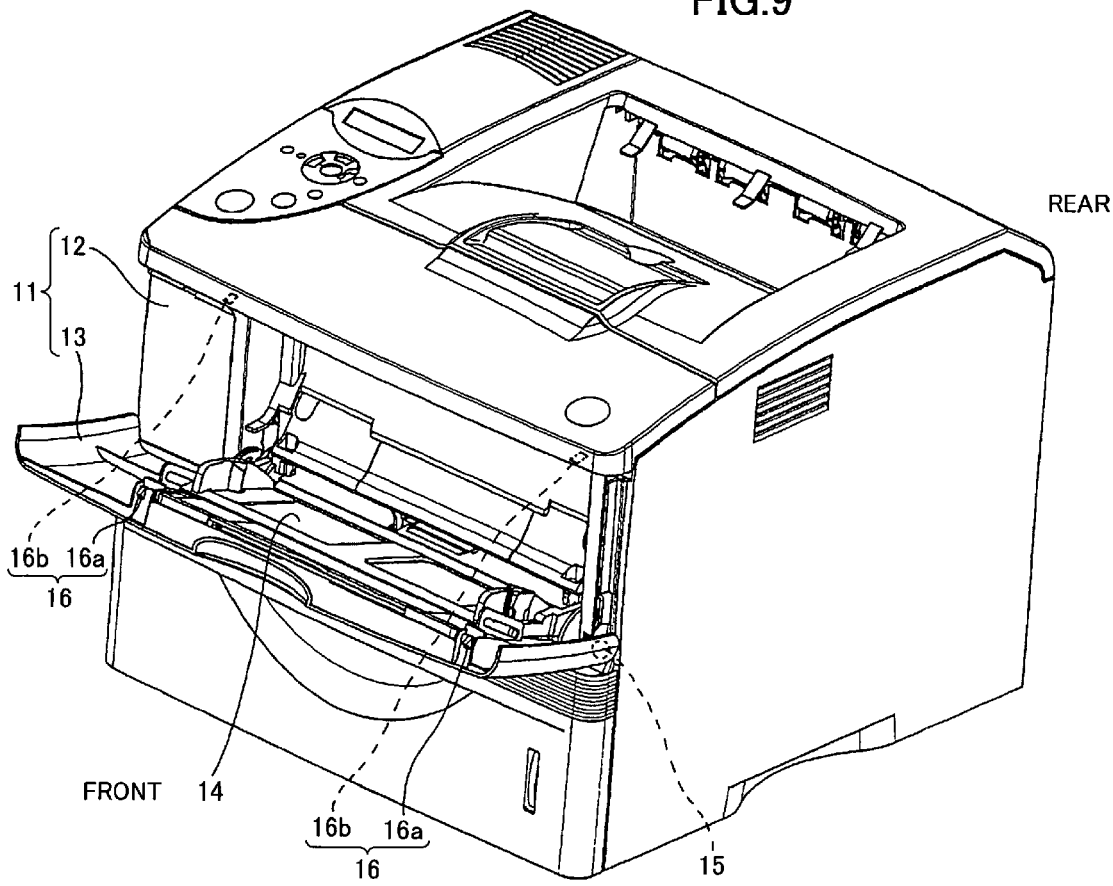
FIG. 9 is a perspective view of the image forming device when a tray cover of the first front cover is open.

As shown in FIG. 9, the first front cover 11 includes a main front cover 12 and a tray cover 13. A rotational shaft 15 is disposed at the lower end of the main front cover 12 to extend in the horizontal direction. The tray cover 13 is pivotably supported on the rotational shaft 15 such that the tray cover 13 can be opened and closed. That is, the tray cover 13 can pivot about the rotational shaft 15 such that its free end (upper end) moves upward and downward. The rotational shaft 15 could be the same shaft as that of the first front cover 11 or a separate shaft. A paper tray 14 is provided on the inner side of the tray cover 13 for holding a stack of paper.

As shown in FIG. 9, the image forming device 100 further includes a second engagement mechanism 16 for engaging the upper portion of the tray cover 13 with the main front cover 12.

The second engagement mechanism 16 includes second claws 16*a* and second engagement members 16*b* for engaging with the respective second claws 16*a*. The second claws 16*a* are provided on one of the main front cover 12 and the tray cover 13, and the second engagement member 16*b* is provided on the other of the main front cover 12 and the tray cover 13.

In this example, the second claws 16*a* are provided on an upper edge portion of the tray cover 13, and the second engagement members 16*b* are provided on the main front cover 12. Each second claw 16*a* is a protrusion protruding upward from the upper edge of the tray cover 13, and each second engagement member 16*b* is a recess that receives the corresponding second claw 16*a*.

A distance between the second claws 16*a* or between the second engagement members 16*b* is approximately the same as the width of the paper tray 14 in the lateral direction.

A portion of the upper edge of the tray cover 13 can bend slightly in the vertical direction. Therefore, when the second claws 16*a* are engaged with the second engagement members 16*b* so as to close the tray cover 13, the second claws 16*a* are pressed slightly downward by the edge portion of the main front cover 12, but the second claws 16*a* return to the initial positions when engaged with the second engagement members 16*b*, so that the second claws 16*a* fit within the second engagement members 16*b*.

Since the tray cover 13 and the main front cover 12 are engaged with each other with the second engagement mechanism 16 described above, it is possible to provide a neat appearance to the front surface of the image forming device 100 while ensuring convenience during manual paper feed printing. Also, the second engagement mechanism 16 can prevent, by simple configuration, a too-loose engagement between the tray cover 13 and the main front cover 12 that might cause the tray cover 13 to separate from the main front cover 12 unexpectedly, and also a too-tight engagement between the tray cover 13 and the main front cover 12 that might make it difficult to disengage the tray cover 13 from the main front cover 12. Further, the second engagement mechanism 16 enables to position the tray cover 13 and the main front cover 12 relative to each other in a simple and also reliable manner.

Figure 10:
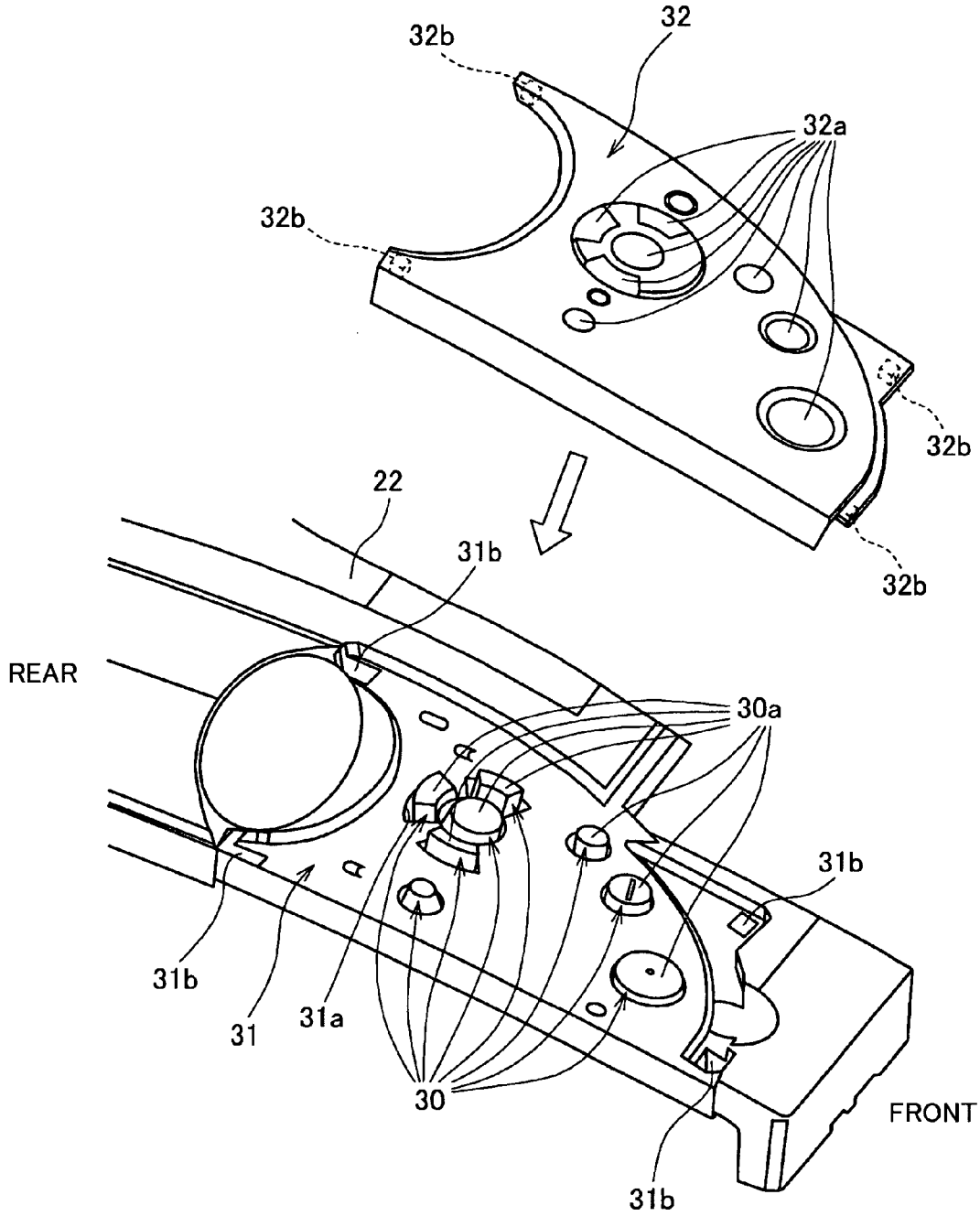
FIG. 10 is a perspective view of a key-top cover separated from a key switch support portion.
Figure 11:
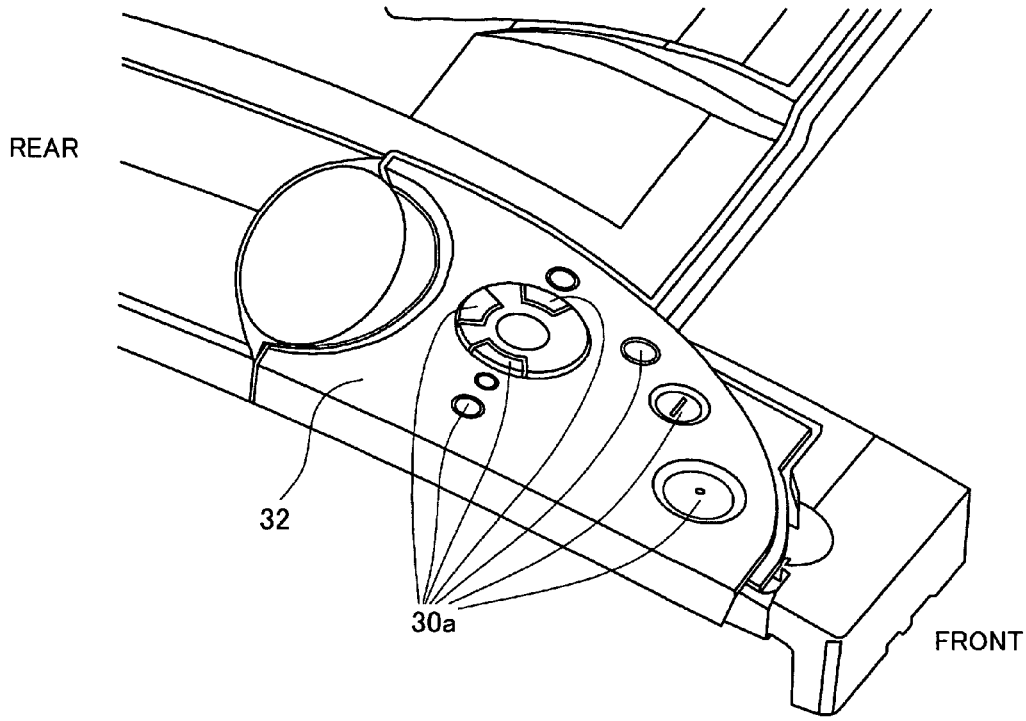
FIG. 11 is a perspective view of the key-top cover mounted on the key switch support portion.

As shown in FIGS. 2 and 10(*a*) to 11, the main casing 1 is provided with a plurality of key switches 30, a key switch support portion 31, and a key-top cover 32. The key switches 30 are for operating the image forming device 100.

As shown in FIG. 10, the key switch support portion 31 is formed integrally with the top cover 22 at the left side edge thereof (FIG. 9). A plurality of through holes 31*a* is formed in the key switch support portion 31. The through holes 31*a* correspond to the key switches 30. When the top cover 22 is mounted in a predetermined position, the key switches 30 pass through the respective through holes 31*a* and protrude beyond the upper panel 22 upwardly.

The key-top cover 32 is formed with a plurality of through holes 32*a* that correspond to the plurality of key switches 30. The key-top cover 32 is for covering the outer surface of the key switch support portion 31. The clearances of the through-holes 32*a* with respect to key-tops 30*a* of the key switches 30 are formed less than the clearances of the through holes 31*a* with respect to the key switches 30.

Two pairs of engagement holes 31*b* and two pairs of engagement protrusions 32*b* are provided on the upper surface of the key switch support portion 31 and the lower surface of the key-top cover 32, respectively. The engagement protrusions 32*b* are formed integrally with the key-top cover 32. When the key-top cover 32 is mounted so as to cover the outer surface of the key switch support portion 31, the engagement protrusions 32*b* are inserted into the engagement holes 31*b* to engage with the same.

Because the clearances of the through holes 32*a* with respect to the key-tops 30*a* are less than the clearances of the through holes 31*a* with respect to the key switches 30 as described above, the key-top cover 32 regulates the position of the key-top 30*a* of each key switch 30 when the key-top cover 32 is mounted on the key switch support portion 31. As a result, the key-tops 30*a* and the key-top cover 32 can be easily and reliably positioned at suitable locations, in which the key-tops 30*a* and the key-top cover 32 together provide a neat appearance to the upper surface of the image forming device 1.

As described above, the plurality of covers of the main casing 2 are positioned with referencing the covers, but not with referencing the frames (3), gaps between the covers can be adjusted in a suitable manner, providing a neat appearance to the image forming device 100. Also, the covers can be decorated more freely. Because the gaps between covers can be adjusted, it is possible to provide decoration that extends continuously over a plurality of the covers, for example.

While some exemplary embodiments of this invention have been described in detail, those skilled in the art will recognize that there are many possible modifications and variations which may be made in these exemplary embodiments while yet retaining many of the novel features and advantages of the invention.

What is claimed is:

1. An image forming device comprising:

an image forming unit that forms images on a recording medium;

a frame disposed around the image forming unit to support the image forming unit;

an exterior case disposed around the frame to accommodate the image forming unit and the frame, the exterior case including a front cover that is openable and closable, an upper panel, and a side panel, both of the front cover and the upper panel configuring an exterior surface of the exterior case, the front cover including a front portion, an upper portion connected to the front portion, and a side portion connected to the front portion, the upper portion being flush with the upper panel when the front cover is closed, the side portion being flush with the side panel when the front cover is closed, an opening being formed as a rectangular cut-out in part of the upper panel; and a first engagement mechanism including a first engagement member provided on the front cover and a second engagement member provided on the upper panel, wherein the image forming unit is inserted into or removed from the exterior case through the opening without moving the frame, wherein when the front cover is closed, the upper portion of the front cover covers the opening, and the first engagement member engages with the second engagement member.

2. The image forming device according to claim 1, wherein the front cover is opened and closed by pivoting in a pivoting direction, and the first engagement mechanism includes a first claw and a first engagement member that engages with the first claw at a predetermined position with respect to the pivoting direction, the first claw being provided to one of the front cover and the upper panel, the first engagement member being provided to the other one of the front cover and the upper panel.

3. The image forming device according to claim 2, wherein the first claw is provided to the front cover, and the first engagement member is provided to the upper panel.

4. The image forming device according to claim 1, wherein the front cover is opened and closed by pivoting in a pivoting direction, and the first engagement mechanism includes a surface and a rib that abuts the surface, the surface being provided to one of the front cover and the upper panel, the rib being provided to the other one of the first cover and the upper panel, the rib protruding in a direction perpendicular to the pivoting direction.

5. The image forming device according to claim 1, the front cover is opened and closed by pivoting in a pivoting direction, and the first engagement mechanism includes a first claw and a first engagement member that engages with the first claw at a predetermined position with respect to the pivoting direction, and one of the first claw and the first engagement member is provided to the upper portion of the front cover, and the other one of the first claw and the first engagement member is provided to the upper panel.

6. The image forming device according to claim 1, wherein the image forming unit includes components, and some of the components of the image forming unit are removed from the exterior case when the front cover is open.

7. The image forming device according to claim 1, further comprising a cassette detachably mounted in the exterior case and supporting a stack of recording medium, the cassette being disposed below the front cover and having a cassette front cover, the cassette front cover being flush with a lower section of the front cover.

8. The image forming device according to claim 7, wherein the cassette front cover is provided with a cassette-cover engagement member that engages with the side cover.

9. The image forming device according to claim 8, wherein the side cover includes a protruding member, the protruding member being formed with a ventilation hole that provides ventilation between an interior and an exterior of the exterior case, and the cassette front cover of the cassette covers over the ventilation hole.

10. The image forming device according to claim 1, further comprising a second engagement mechanism, wherein:

the front cover includes a main cover and a tray cover, the tray cover being provided with a tray for supporting a recording medium at an inner side of the tray cover;

the tray cover is supported on a shaft disposed at a lower end of the main cover, the tray cover pivoting about the shaft such that an upper section of the tray cover moves upward and downward; and the second engagement member engages the upper section of the tray cover with the main cover.

11. The image forming device according to claim 10, wherein the second engagement member includes a second claw and a second engagement member that engages with the second claw, the second claw being provided to one of the main cover and the tray cover, the second engagement member being provided to the other one of the main cover and the tray cover.

12. The image forming device according to claim 11, wherein the second claw is provided to the tray cover, and the second engagement member is provided to the main cover.

13. The image forming device according to claim 1, further comprising a plurality of operation keys having key tops, wherein the main exterior case further includes a key-switch supporting section that supports the plurality of operation keys, and a top cover that covers the key-switch supporting section, the top cover being formed with a plurality of through holes corresponding to the key tops of the respective operation keys, and the through holes regulates positions of the key tops of the operation keys when the top cover is mounted on and covering the key-switch supporting section.

14. The image forming device according to claim 13, wherein the key-switch supporting section is formed integrally with the upper panel.

15. An exterior case of an image forming device, the exterior case comprising:

a front cover that is openable and closable, the front cover including a front portion, an upper portion connected to the front portion, and a side portion connected to the front portion;

an upper panel; and a side panel, wherein both of the front cover and the upper panel configure an exterior surface of the exterior case, the upper portion being flush with the upper panel when the front cover is closed, the side portion being flush with the side panel when the front cover is closed, an opening being formed as a rectangular cut-out in part of the upper panel;

a first claw provided to one of the front cover and the upper panel; and a first engagement member provided to the other one of the front cover and the upper panel, the first engagement member engaging with the first claw, thereby positioning the front cover at a predetermined location relative to the front cover, wherein when the front cover is closed, the upper portion of the front cover covers the opening, and the front cover engages with the upper panel by the first engagement mechanism.

16. The exterior case according to claim 15, wherein the first claw is provided to the front cover, and the first engagement member is provided to the upper panel.

17. The exterior case according to claim 15, further comprising a second claw and a second engagement member, wherein:

the front cover includes a main cover and a tray cover, the tray cover being provided with a tray for supporting recording medium at an inner side of the tray cover;

the second claw is provided to one of the main cover and the tray cover;

the second engagement member is provided to the other one of the main cover and the tray cover, the second engagement member engaging with the second claw.

18. The exterior case according to claim 17, wherein the second claw is provided to the tray cover, and the second engagement member is provided to the main cover.

* * * * *